US005605485A

United States Patent [19]

Spector

[11] Patent Number: 5,605,485

[45] **Date of Patent: *Feb. 25, 1997**

[54] WATER-PISTOL AND ANIMAL FIGURE ASSEMBLY

[76] Inventor: Donald Spector, 380 Mountain Rd., Union City, N.J. 07080

[ * ] Notice: The term of this patent shall not extend beyond the expiration date of Pat. No. 5,564,961.

[21] Appl. No.: 554,259

[22] Filed: Nov. 6, 1995

Related U.S. Application Data

[63] Continuation-in-part of Ser. No. 431,834, May 1, 1995, Pat. No. 5,564,961.

[51] Int. Cl.[6] ..... A63H 3/00; A63H 33/30

[52] U.S. Cl. ..... 446/72; 446/473; 446/475; 222/78; 222/79; 239/211

[58] Field of Search ..... 446/71, 72, 74, 446/267, 268, 327, 329, 473, 475, 483; 222/78, 79; 239/211, 154

[56] References Cited

U.S. PATENT DOCUMENTS

| | | | |
|---|---|---|---|
| 1,660,085 | 2/1928 | Nassau | 446/74 X |
| 1,694,959 | 12/1928 | Ament | 222/78 X |
| 1,767,911 | 6/1930 | Berko et al. | 446/74 X |
| 3,299,891 | 1/1967 | Smeton | 446/74 X |
| 4,334,383 | 6/1982 | Melotti | 446/473 X |
| 5,297,980 | 3/1994 | Barthold | 446/74 X |

*Primary Examiner*—Robert A. Hafer
*Assistant Examiner*—D. Neal Muir
*Attorney, Agent, or Firm*—Michael Ebert

[57] ABSTRACT

A water-pistol and stuffed animal figure in which a pistol concealed in the figure is operable to cause water to spit out of the mouth of the figure. The pistol includes a hand grip provided with a trigger, a water reservoir in the form of a cartridge clip insertable in the grip, and a pump which draws water from the reservoir and pumps it into the barrel of the pistol from whose nozzle the water is ejected when the trigger is pulled. The animal figure includes a head having an open mouth and a body having an internal cavity which is open at its underside and communicates with the head. The pistol is received within the cavity with its barrel socketed in the head of the figure and its nozzle aligned with the open mouth whereby when a player who grasps the grip with his hand then appears to be holding the figure, and when he then pulls the trigger, water is ejected from the mouth of the figure who then appears to be spitting.

6 Claims, 2 Drawing Sheets

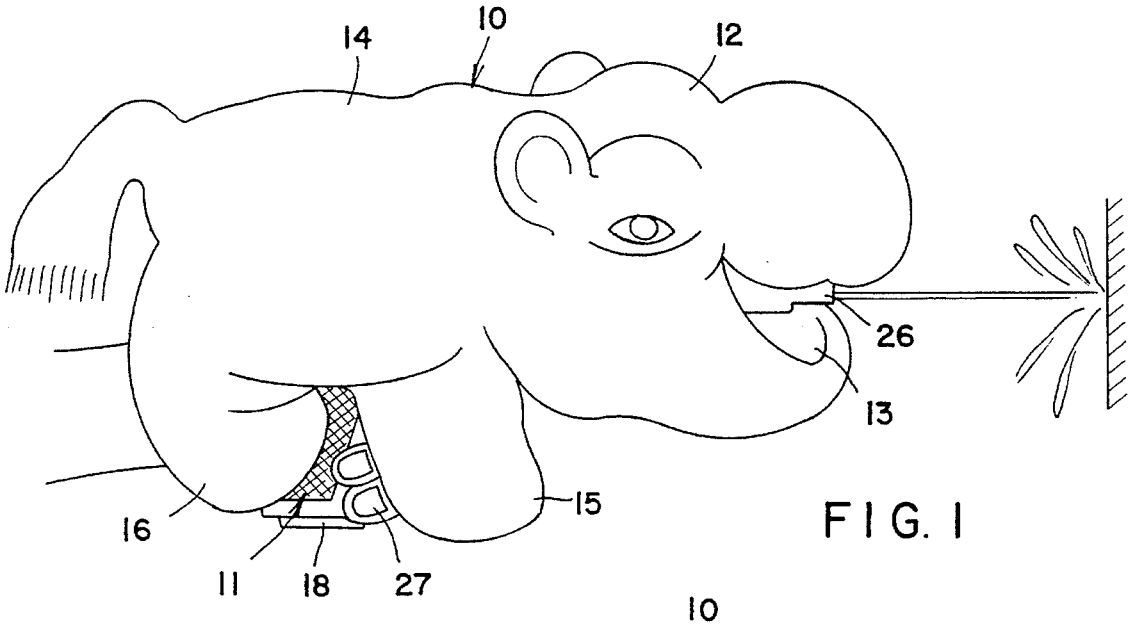
FIG. 1
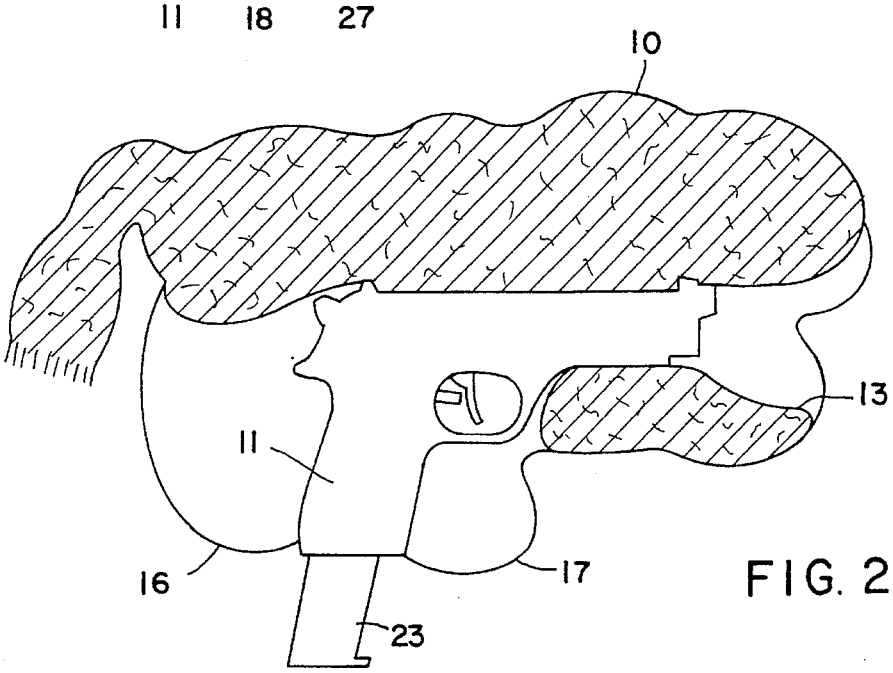
FIG. 2
FIG. 3
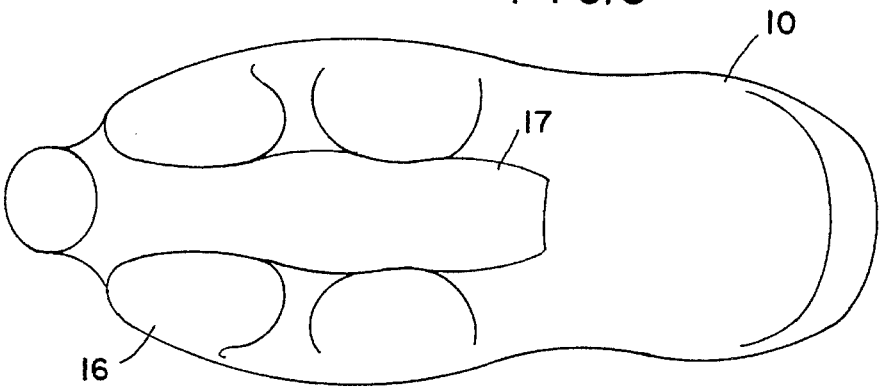

WATER-PISTOL AND ANIMAL FIGURE ASSEMBLY

RELATED APPLICATION

This application is a continuation-in-part of my application Ser. No. 08/431,834, filed May 1, 1995, now U.S. Pat. No. 5,564,961 entitled "WATER-PISTOL AND PUPPET ASSEMBLY" whose entire disclosure is incorporated herein by reference.

BACKGROUND OF INVENTION

1. Field of Invention

This invention relates generally to water-pistols and more particularly to a water-pistol and stuffed animal figure assembly which when a player grasps the grip of the pistol housed within the figure, he then appears to be holding the figure, and when he operates the pistol to eject water therefrom, the animal then appears to be spitting out this water.

2. Status of Prior Art

Children enjoy playing with stuffed animal figures, for these soft figures which resemble familiar animals such as lions and tigers, have a plush covering and can be squeezed, hugged and otherwise manipulated in play. A long-time favorite is the classic Teddy Bear.

Stuffed animal figures representing various animals are available in most toy stores, making it possible for a child to choose his favorite animal as a pet.

A water-pistol is also a highly popular toy, for children take delight in spraying other children with water. All water pistols regardless of their internal mechanism, include a hand grip provided with a trigger which when pulled by the player grasping the grip, then draws liquid from a liquid reservoir housed in the pistol and pumps the liquid into a barrel from whose outlet nozzle the liquid is ejected.

In recent years, the trend in water-pistol design has been toward creating realistic replicas of military or police small arms. This makes it possible for children playing with these water-pistols to imitate a cops and robbers gun fight or actual military combat. Most toys which children enjoy seek to emulate adult activity. Thus a child playing with a toy automobile prefers that this toy vehicle closely resemble a model of a Cadillac or other well-known auto, rather than being purely fanciful.

But water-pistols which resemble real weapons are now in public disfavor, and in some states they are banned. The reason for the interdiction of water-pistols which are replicas of real weapons is that crime is now rampant in the streets of most American cities and even in many suburbs. Police under stress may be unable to distinguish between a real gun and a water-pistol that is a replica of this gun. As a consequence of this confusion, there are instances where a police officer has shot a child pointing a water-pistol at him, thinking it was a real gun.

Yet water-pistols are essentially innocuous and it is unfair to deprive children of the joys of playing with these pistols. On the other hand, an exposed water-pistol is no longer acceptable to the public. Of prior art background interest is the U.S. Pat. No. 3,578,789 to Ferri showing a water pistol having a trigger-actuated pump for withdrawing liquid from a reservoir and supplying it to the nozzle of the gun.

In my above-identified copending application, there is disclosed a water-pistol and puppet assembly in which a pistol is concealed within the shroud of the puppet. When a player grasps the grip of the pistol, he then appears to be manipulating the puppet. In this assembly, the barrel of the pistol is socketed in the head of the puppet, with its outlet nozzle in alignment with the open mouth. When a player grasping the grip of the pistol pulls the trigger, this causes liquid to be ejected from the outlet nozzle, and the puppet then appears to be spitting.

The typical water pistol has its water reservoir placed above the grip in line with the barrel of the gun, the reservoir being provided with a removable stopper so that the water can be replenished. When therefore the water in the pistol reservoir is exhausted, one had to withdraw the pistol from the puppet to replenish the water and then return the water-loaded pistol to the puppet. This reloading procedure is somewhat difficult for many children to carry out, and is at the very least inconvenient.

SUMMARY OF INVENTION

In view of the foregoing, the main object of this invention is to provide an operating water-pistol that is disguised as a stuffed animal figure so that one who sees the figure has no idea of its true function, yet the child who plays with the concealed pistol can shoot water therefrom.

More particularly, an object of this invention is to provide a water-pistol and stuffed animal figure assembly in which the player appears to be holding the figure, but when the player pulls the trigger of the pistol concealed within the figure, then liquid is squirted from the open mouth of the figure who appears to be spitting.

A significant advantage of an assembly in accordance with the invention is that it may include a standard water-pistol of any design, even one that is a replica of a real weapon, for the water-pistol is concealed by the figure and its appearance is never visible when the figure is being held in the hand of a player.

Also an object of the invention is to provide an assembly of the above type in which the water-pistol may be reloaded without removing it from the stuffed animal figure.

Briefly stated, these objects are attained by a water-pistol and stuffed animal figure assembly in which the pistol is concealed within the figure, yet is fully operable. The pistol includes a hand grip provided with a trigger, a liquid reservoir in the form of a cartridge chip insertable in the grip and a pump which when the trigger is pulled then draws liquid from the reservoir and pumps it into the barrel of the pistol from whose outlet nozzle the liquid is ejected. The figure includes a head having an open mouth that simulates that of an animal, and a body having an internal cavity that is open at its underside and communicates with the head.

The pistol is received within the body cavity with its barrel socketed in the head of the figure so that its outlet nozzle is in alignment with the open mouth. When a player extends his hand into the cavity to grasp the grip of the pistol, he then appears to be holding the figure. And when the player pulls the trigger to cause liquid to be ejected from the outlet nozzle, the figure then appears to be spitting out this liquid.

BRIEF DESCRIPTION OF DRAWINGS

For a better understanding of the invention, as well as further features thereof, reference is made to the detailed description thereof to be read in connection with the annexed drawings wherein:

FIG. 1 is a perspective view of a water-pistol and stuffed animal figure assembly in accordance with the invention;

FIG. 2 is a cut away view of the animal figure showing pistol concealed within the figure;

FIG. 3 is an underside view of the figure;

DESCRIPTION OF INVENTION

Figure 4:
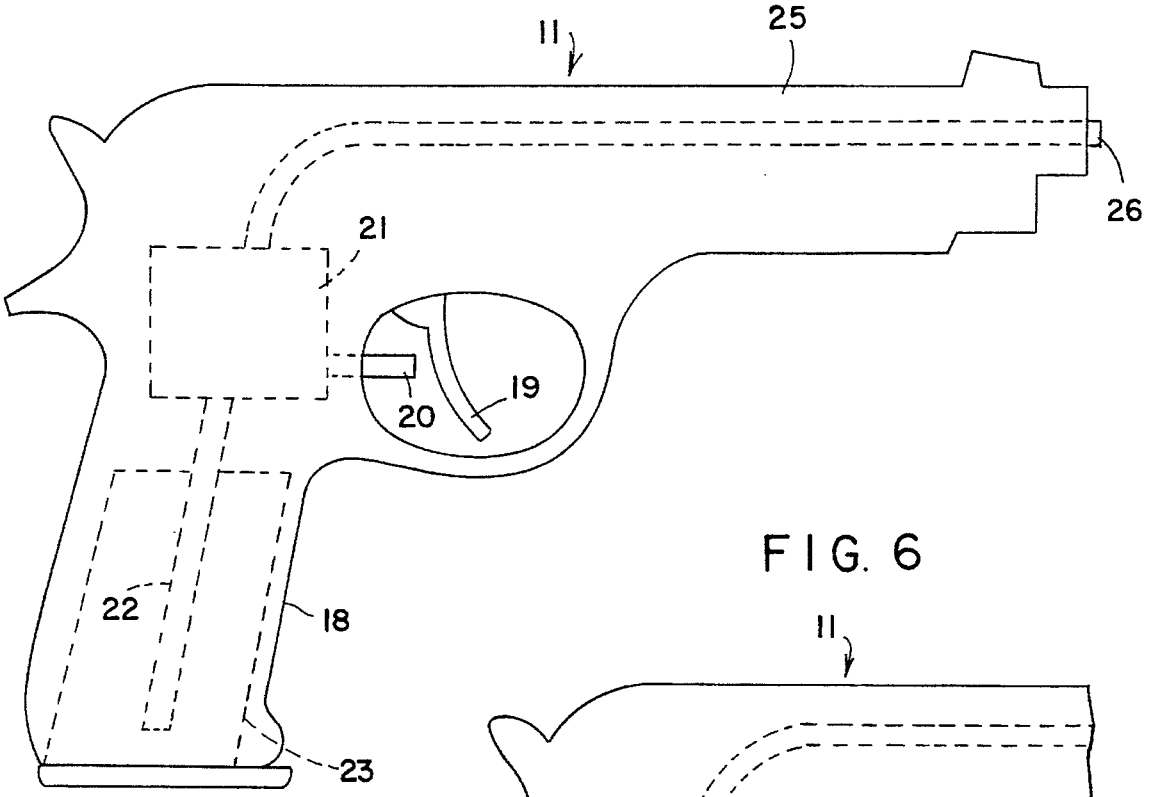
FIG. 4 is a separate view of the water-pistol.

FIGS. 1 to 3 illustrate a water-pistol and stuffed animal figures assembly in accordance with one preferred embodiment of the invention. The figure is generally designated by reference numeral 10 and the pistol by reference numeral 11.

Animal FIG. 10 has the form of a hippopotamus having a massive head 12 whose mouth 13 is open, and an elongated body 14 running from the head and terminating in a tail. Body 14 is provided with a pair of forelegs 15 and a pair of rear legs 16. FIG. 10 is of soft plush construction with a plush outer skin and an interior stuffing of cotton batting or flexible foam plastic material. Hence the figure may be manipulated like a conventional plush figure.

Animal FIG. 10 is provided with an internal cavity 17 that runs the full length of body 14 and is open on the underside of the body to accommodate pistol 11.

Figure 6:
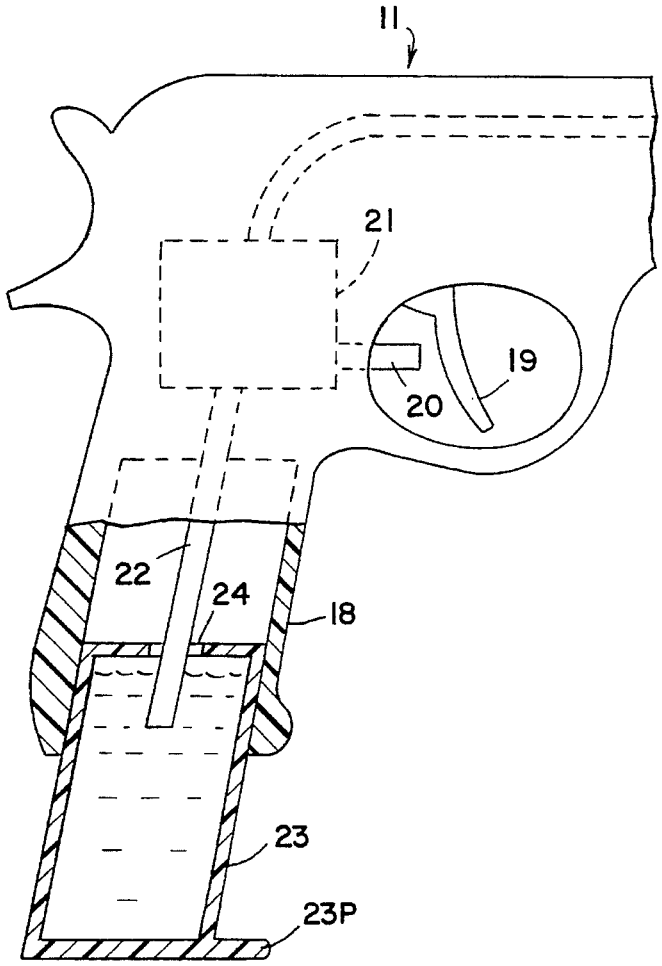
FIG. 6 shows the internal mechanism of the pistol.
Figure 5:
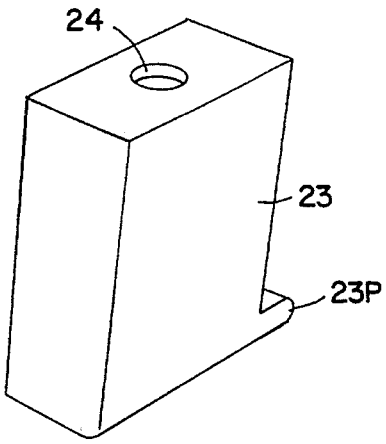
FIG. 5 shows the removable cartridge clip of the pistol.

Pistol 11, as best seen in FIGS. 4 to 6, includes a hand grip 18 provided with a trigger 19 that when pulled engages and pushes in a spring-loaded piston rod 20 which then actuates a water pump 21. Pump 21 is coupled by way of a siphon 22 to a water-reservoir in the form of a removable cartridge clip 23 (see FIG. 5) Clip 23 has an orifice 24 at its top end to receive the siphon 22.

Clip 23 is insertable in grip 18 of the pistol, so that when the reservoir is in place, and trigger 19 is pulled, pump 21 is then actuated to draw water from the reservoir and pump it into the barrel 25 of the pistol, the barrel having an outlet nozzle 26 at its front end. What comes out of the nozzle is not a continuous stream of water, but a squirt or pulse of water, for each time trigger 18 is pulled, piston rod 20 is pushed in to actuate the pump and thereby produce a squirt of water, the rod returning to its normal pushed-out position when the trigger is released.

As shown in FIG. 2, pistol 10, when concealed within the internal cavity of the figure, has its barrel socketed in the open mouth 13 of the figure so that the outlet nozzle 26 is then aligned with the mouth. When the pistol trigger is pulled, water spits out of the mouth as if the hippopotamus were spitting.

The advantage of this water pistol and animal figure assembly is that one can replenish the water reservoir without having to remove the pistol from the animal figure to do so. Since the cartridge clip 23 is soketed in the grip of the pistol and the finger piece 23 P at the bottom of the clip is at the exposed lower end of the grip, one has easy access to the cartridge clip at the open underside of the animal figure. Hence it is a simple matter to withdraw an empty cartridge clip form the grip of the pistol, to refill it with water and to reinsert it in the grip.

As shown in FIG. 1, a player grasps grip 18 of the pistol with the fingers 27 of his hand that the player appears to be holding the animal figure which he can point in any direction. But an observer seeing the held animal figure is not aware of the water-pistol concealed therein, and when the player pulls the trigger to cause the figure to spit in the direction of the observer, this startling action comes as a surprise to the observer.

In practice, a group of players can carry different types of animal figures, such as pigs, leopards, etc. and in a mock battle of these animals, each player holding an animal will seek to wet and thereby effectively shoot the other players so that the winning animal is the one who has wet the greater number of competing players.

While there has been shown a preferred embodiment of a water-pistol and animal figure assembly in accordance with the invention, it is to be understood that many changes may be made therein without departing from the spirit of the invention.

I claim:

1. A water pistol and animal figure assembly comprising:

A. an animal figure having a head provided with an open mouth, a body joined to the head having an internal cavity communicating with the head, the cavity being open at an underside of the body; and B. a water pistol concealed in the cavity of the figure, said pistol having a barrel whose front end is socketed in the head and is provided with a nozzle in alignment with the open mouth, said pistol having a hand grip provided with a trigger which when the grip is grasped by the fingers of a player's hand extended into the cavity, the figure then appears to be held by the player, and when the player pulls the trigger with a finger of his hand, water is then ejected from the nozzle and spit out of the open mouth of the figure.

2. An assembly as set forth in claim 1, in which the pistol is provided with a water reservoir and a pump which when the trigger is pulled, then draws water from the reservoir and pumps it into the barrel.

3. An assembly as set forth in claim 1, in which the animal figure is that of a four legged animal and said body is provided with leg extensions.

4. An assembly as set forth in claim 1, in which the animal figure is a stuffed, soft, plush figure.

5. An assembly as set forth in claim 2, in which the pistol is provided with a removable cartridge clip that is insertable in said grip and functions as said water reservoir whereby said reservoir may be refilled with water by withdrawing the clip from the grip without removing the pistol from the cavity.

6. An assembly as set forth in claim 2, in which the pump is provided with a spring-biased piston rod that is engaged by the trigger, so that each time its trigger is pulled, the piston rod is pushed in to actuate the pump to produce a squirt of water.

* * * * *